US009243425B2

(12) United States Patent
Scullion

(10) Patent No.: US 9,243,425 B2
(45) Date of Patent: Jan. 26, 2016

(54) SAFETY BARRIER SYSTEM

(71) Applicant: Mark James Scullion, Gold Coast (AU)

(72) Inventor: Mark James Scullion, Gold Coast (AU)

( * ) Notice: Subject to any disclaimer, the term of this patent is extended or adjusted under 35 U.S.C. 154(b) by 0 days.

(21) Appl. No.: 14/532,491

(22) Filed: Nov. 4, 2014

(65) Prior Publication Data

US 2015/0123062 A1 May 7, 2015

Related U.S. Application Data

(60) Provisional application No. 61/900,409, filed on Nov. 6, 2013.

(51) Int. Cl.
*E04H 17/14* (2006.01)
*E01F 13/02* (2006.01)

(52) U.S. Cl.
CPC ..... *E04H 17/143* (2013.01); *E01F 13/022* (2013.01); *E04H 17/1408* (2013.01); *E04H 2017/1473* (2013.01)

(58) Field of Classification Search
CPC ..... E01F 13/028; E01F 15/04
USPC ..... 256/59–62, 66, 68, 71, 65.01, 65.02, 256/65.03
See application file for complete search history.

(56) References Cited

U.S. PATENT DOCUMENTS

| | | | | |
|---|---|---|---|---|
| 3,960,367 | A * | 6/1976 | Rogers | 256/21 |
| 5,407,178 | A * | 4/1995 | Long | 256/45 |
| 5,961,242 | A * | 10/1999 | Leone | 403/234 |
| 6,386,519 | B1 * | 5/2002 | Priefert | 256/68 |
| 2008/0173854 | A1 * | 7/2008 | Meaux et al. | 256/23 |
| 2009/0057637 | A1 * | 3/2009 | Galla | 256/1 |

* cited by examiner

*Primary Examiner* — Daniel Wiley
(74) *Attorney, Agent, or Firm* — Joseph S. Heino; Patrick M. Bergin

(57) ABSTRACT

A safety barrier system is a visual barrier having a rigid and detachable top and bottom rail. The barrier is of light weight construction, its main components being made of aluminum and nylon. It consists of a top and bottom T-shaped aluminum rail, the rails being joined by nylon straps of various widths that are suspended between the rails, the widths and spacing of the straps depending on the particular configuration, of which there may be a number of variations. At each rail end, both top and bottom rails, there is a loop of nylon strap. The straps are used to fix the barrier to the T-top bollards or star pickets. The top rail ends can include secondary straps for binding the ends of the top rail to the ends of a bottom rail when a section of the safety barrier is rolled up for storage or transport.

7 Claims, 2 Drawing Sheets

SAFETY BARRIER SYSTEM

This application claims the benefit and priority of U.S. Provisional Patent Application No. 61/900,409 filed on Nov. 6, 2013.

FIELD OF THE INVENTION

The present invention relates generally to the safety industry. The present invention also relates generally to visual safety barriers. More specifically, the present invention relates to a visual safety system of the type that can be used to create a barrier between safe areas and areas of potential danger or to create designated walk ways. The system of the present invention is also drawn to system elements that are highly visibility, thereby enhancing the safety of the system.

BACKGROUND OF THE INVENTION

The art of visual safety barriers is well known. At present, several different types of light weight visual safety barriers are available for use. One type of barrier uses flags, which typically comprise a long continuous rope to which is attached a number of orange vinyl flags, the flags being spaced evenly apart from one another. A second type of barrier uses tape, which typically comprises a long continuous roll of thin plastic tape. Still another type of barrier is a bunting, which comprises a long wide roll of perforated plastic sheeting. Each type of prior art light weight visual safety barriers has drawbacks, however.

For example, each barrier type mentioned above is typically a product that is sold in rolls that are 30 to 50 meters long. This means that, if a shorter length of product is needed for a given application, a shorter length of product must be cut from the roll and, in most cases, is simply discarded after use. Although doing so would seem to be convenient, it results in a waste of material.

Further, each such barrier type may typically be used in conjunction with a post to which lines are attached, which post is either a "T-top bollard" in sites where the ground is relatively flat or a "star picket" post if the site requires post location on grass or natural terrain. Star picket posts, also known as T posts or Y posts, are a kind of metal fence post which is made of low carbon steel, or sometimes rail steel. The names are derived from the shape of cross sections of the posts, including three-pointed star shape, T shape, "peach shape" and other various shapes.

Problems are known to occur when the T-top bollards or star pickets are placed in random spacing, such as when the T-top bollards or star pickets placed too far apart from on another, around an unsafe work area; the flags, tape or bunting are then wound around the T-top bollards or star pickets; and then pulled tight. The problem with this configuration is that the T-top bollards or star pickets tend to tip and then collapse inwardly of their placement, thereby compromising the integrity of all or a portion of the safety barrier.

Another problem that is encountered at construction sites relates to the need for workers to enter the unsafe work zone that has been barricaded by using the types of flags, tape or bunting as described above. Because the barrier created by the flags, tape or bunting may be placed as one continuous length of product that is simply wrapped around a number of the T-top bollards or star pickets, there is no point of separation and no safe way to enter. What typically happens on the work site is that workers will resort to cutting, tearing or pushing down on the flags, tape or bunting just to enter the unsafe worksite, thereby again compromising the barrier or a portion of it. This is an unsafe act which creates risk for the worker, other workers and for others near the barrier who could trip and fall into the hazard being barricaded, such as an open trench, because a portion of the barrier has been compromised. Once cut or torn, the ends of the flags, tape or bunting are not easily reattached.

In the view of this inventor, there is a need for a safety barrier system that overcomes the shortcomings of this prior art.

SUMMARY OF THE INVENTION

In view of the foregoing, this inventor has devised a safety barrier system that is a visual barrier having a rigid and detachable top and bottom rail. The barrier is of light weight construction, its main components being made of aluminum and nylon. It consists of a top and bottom T-shaped aluminum rail, the rails being joined by means of nylon straps of various widths that are suspended between the rails, the widths and spacing of the straps depending on the particular configuration, of which there may be a number of variations. At each rail end, both top and bottom rails, there is a loop of nylon strap. The straps are used to fix the barrier to the T-top bollards or star pickets. Further, the top rail ends can include secondary straps for binding the ends of the top rail to the ends of a bottom rail when a section of the safety barrier is rolled up for storage or transport.

The foregoing and other features of the present invention will be apparent from the detailed description that follows.

DETAILED DESCRIPTION

Figure 2:
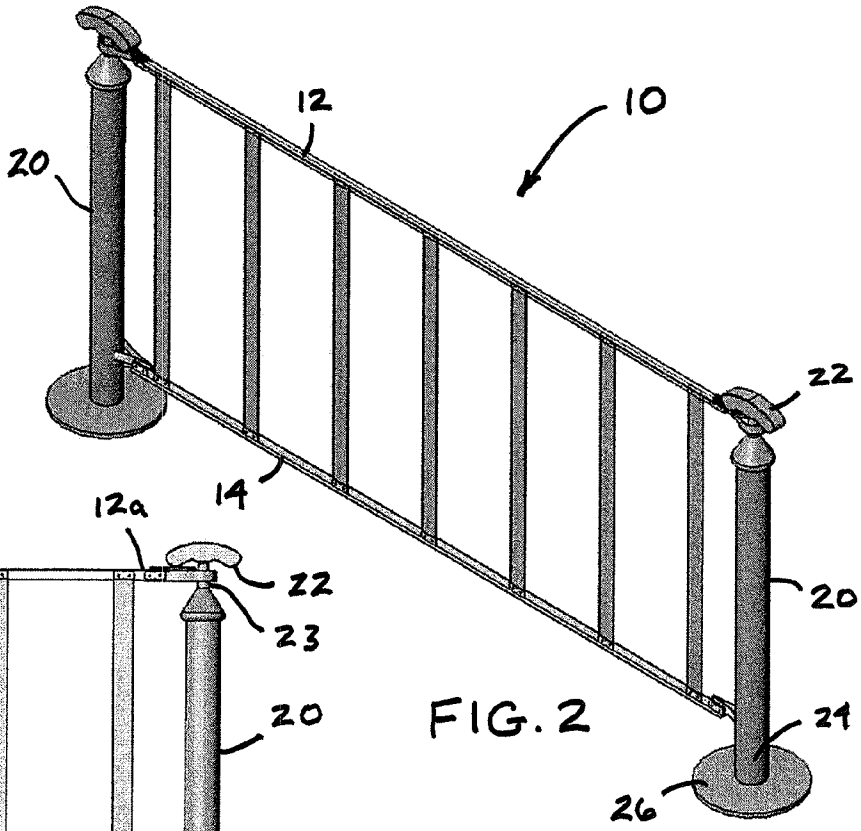
FIG. 2 is a perspective view of the section shown in FIG. 1.
Figure 1:
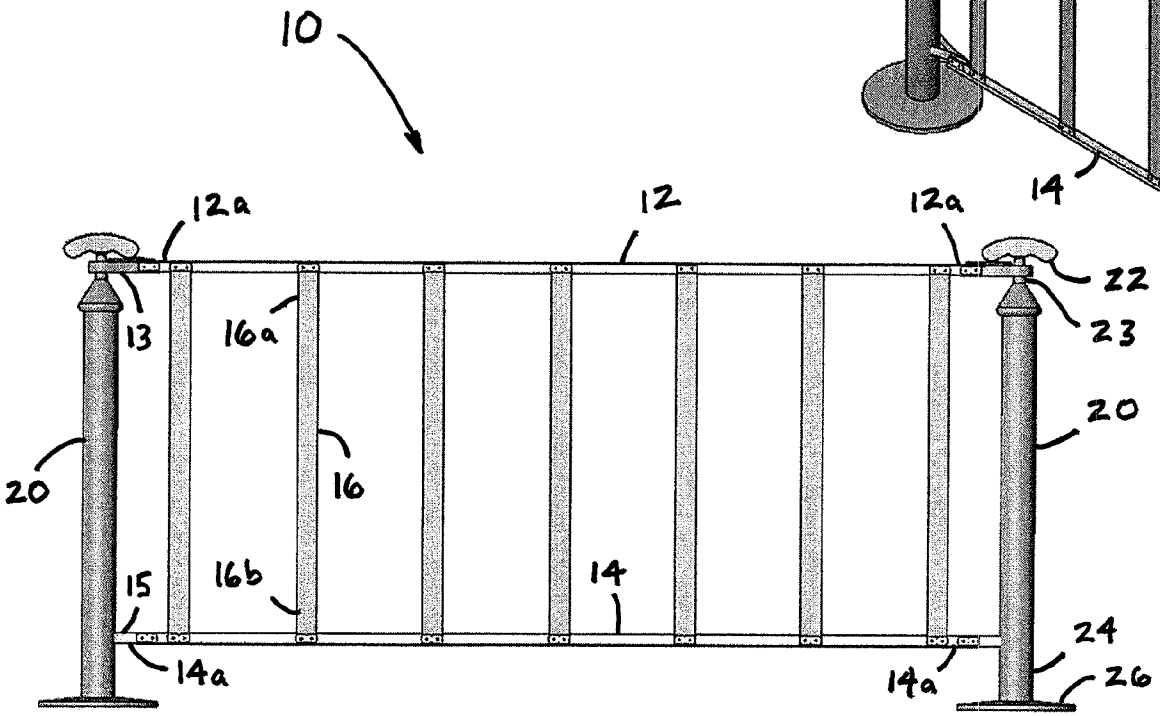
FIG. 1 is a front elevation view of one section of the safety barrier system that is constructed and configured in accordance with the present invention.
Figure 4:
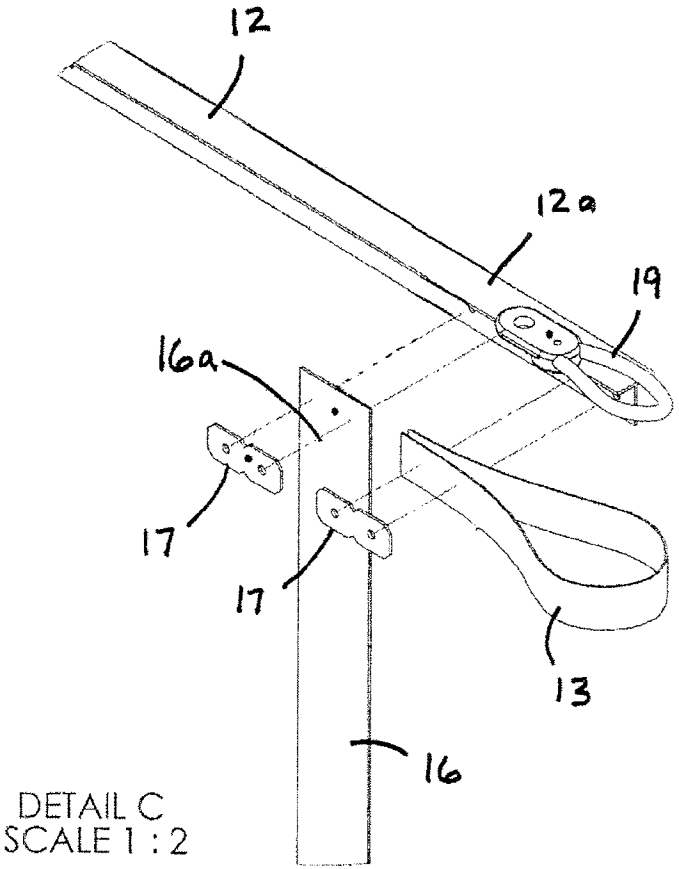
FIG. 4 is an enlarged view of one portion of the section shown in FIG. 3.
Figure 3:
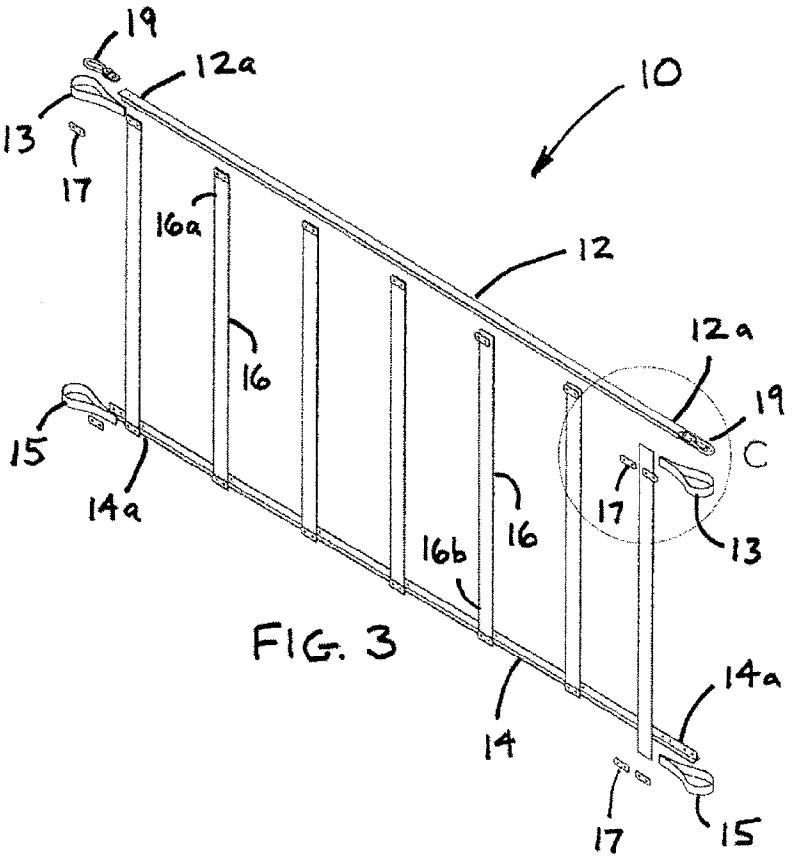
FIG. 3 is a view similar to that shown in FIG. 2, but showing the section in exploded view.

Referring now to the drawings in detail, wherein like numbered elements refer to like elements throughout, FIG. 1 shows a front elevation view of one preferred embodiment of the present invention. As shown, one section of the barrier system, generally identified 10, comprises a substantially rigid and longitudinally extending top rail 12, a substantially rigid and longitudinally extending bottom rail 14 and a plurality of flexible straps 16, each strap 16 extending downwardly from the top rail 12 to the bottom rail 14. The top rail 12 and the bottom rail 14 are intended to be aligned in a substantially horizontal and parallel formation.

Each strap 16 comprises a top strap portion **16*a* and a bottom strap portion 16*b*, the top strap portion 16*a* being secured to a portion of the top rail 12 and the bottom strap portion 16*b* being secured to a portion of the bottom rail 14. When the plurality of straps 16 is attached in this fashion, the straps 16 tend to be aligned in a substantially vertical and parallel formation. In the preferred embodiment, the straps 16 are made of nylon ranging in widths from 50 mm to 1800 mm. However, the precise width of the straps 16 is not a limitation of the present invention, nor is the amount of spacing between adjacent straps 16, the width and spacing being dependent on any particular configuration that is desired or required. Further, other materials could be used for the straps 16 as long as they meet the dual requirements of being light weight and strong, and such is not a limitation of the present invention. It is also possible that the straps 16 be made of a brightly colored and/or a light reflective material, thereby making the straps 16** easily seen, and intentionally so.

Securement of the strap ends 16*a*, 16*b* to the top rail 12 and the bottom rail 14, respectively, is accomplished by using a bracket 17 that is fastened to each rail 12, 14 using a pop rivet, although any type of suitable fastener could be used without deviating from the spirit of this invention.

As shown, the longitudinally extending rails 12, 14 are configured as T-shaped structures. While this provides rigidity to the section 10, other shapes for the rails 12, 14 are within the scope of this invention as well. Further in the preferred embodiment, an aluminum extrusion is used for each rail 12, 14, but the present invention is not limited to aluminum as other materials could be used with similar efficacy. The use of aluminum, however, provides the dual benefit of strength and light weight construction, as is the case with the straps 16. In this configuration, it is to be appreciated that the rails 12, 14 and straps 16 could be rolled into a relatively compact configuration for transporting those elements from one site to another, as will be apparent later in this detailed description.

Notably, each rail 12, 14 comprises opposing end portions 12*a*, 14*a*, respectively. Disposed at each end portion 12*a*, 14*a* is a top loop 13 and a bottom loop 15, respectively. The purpose of the loops 13, 15 is to allow suspension of the rails 12, 14 between two posts to which lines are attached and are in the shape of a T-top bollard or two star picket, generally identified 20, as shown in FIG. 1. The T-top bollard 20 illustrated comprises a top portion 22 and a bottom portion 24, the bottom portion 24 further comprising a stabilizing foot 26. The top portion 22 further comprises a neck 23. In the system 10 of the present invention, the bottom loop 15 is slightly longer in circumference than that of the top loop 13 such that the bottom loop 15 can easily slide over the top portion 22 of the T-top bollard 20. The bottom loop 15 will then slide down to the bottom portion 24 of the T-top bollard 20. The top loop 13 can then be placed over the top portion 22 and neck 23 of the T-top bollard 20. Because the circumference of the top loop 13 is smaller, the top loop 13 sits nicely just below the "T" on top of the T-top bollard 20. If the assembly 10 is used with a star picket post, the top loop 13 will sit nicely in an L-shaped slot cut into the picket.

As alluded to previously, the aluminum rails 12, 14 and the straps 16 can be rolled into a relatively compact configuration for transporting those elements from one site to another. To assist in that functionality, a secondary loop 19 is provided at each at each end portion 12*a* of the top rail 12. The secondary loops 19 are provided such that, when the rails 12, 14 and straps 16 are rolled up, the secondary loops 19 can be placed over each of the end portions 14*a* of the bottom rail 14 so that the rails 12, 14 and straps 16 remain secured together for transport or storage.

The details of the invention having been disclosed in accordance with the foregoing, I claim:

1. A safety barrier system comprising:

a pair of substantially vertical posts with a lower portion configured to rest on a ground surface, and an enlarged upper portion;

a rigid and longitudinally extending top rail, the top rail comprising opposing end portions and each end portion of the top rail comprising a loop of nylon strap;

a rigid and longitudinally extending bottom rail, the bottom rail comprising opposing end portions and each end portion of the bottom rail comprising a loop of nylon strap; and a plurality of flexible straps extending generally vertically between the top rail and the bottom rail;

wherein the loops of nylon strap at the end portions of the top and bottom rails are slid over the enlarged upper portion of each post, such that the loops of the top rail are positioned below the enlarged upper portions of the posts, and the loops of the bottom rail are positioned above the lower portions of the posts.

2. The safety barrier system of claim 1 wherein each flexible strap comprises a top strap portion and a bottom strap portion, the top strap portion being secured to the top rail and the bottom strap portion being secured to the bottom rail.

3. The safety barrier system of claim 2 wherein each top and bottom strap portion is secured by means of a bracket and a fastener.

4. The safety barrier system of claim 1 wherein each rail comprises an aluminum extrusion.

5. The safety barrier system of claim 1 wherein each flexible strap comprises a high visibility nylon.

6. The safety barrier system of claim 1 further comprising a secondary loop at each end portion of the top rail.

7. The safety barrier system of claim 1 wherein each post is a T-top bollard or a star picket post.

* * * * *